US005782557A

United States Patent [19]

Young

[11] Patent Number: 5,782,557

[45] Date of Patent: Jul. 21, 1998

[54] HOMOGENIZING APPARATUS

[75] Inventor: David John Young, Chorleywood, United Kingdom

[73] Assignee: Eastman Kodak Company, Rochester, N.Y.

[21] Appl. No.: 633,716

[22] PCT Filed: Oct. 28, 1993

[86] PCT No.: PCT/EP94/03504

§ 371 Date: Apr. 16, 1996

§ 102(e) Date: Apr. 16, 1996

[87] PCT Pub. No.: WO95/11742

PCT Pub. Date: May 4, 1995

[30] Foreign Application Priority Data

Oct. 28, 1993 [GB] United Kingdom ..... 9322228

[51] Int. Cl.[6] ..... B01F 5/06

[52] U.S. Cl. ..... 366/176.2; 366/340

[58] Field of Search ..... 366/167.1, 174.1, 366/175.2, 176.1, 176.2, 182.1, 336, 338, 339, 340; 138/37, 40, 42, 43, 46; 251/208, 264, 273

[56] References Cited

U.S. PATENT DOCUMENTS

| | | | |
|---|---|---|---|
| 1,898,894 | 2/1933 | Richards et al. . | |
| 4,348,116 | 9/1982 | Bordas . | |
| 5,421,650 | 6/1995 | Meyer | 366/339 X |

FOREIGN PATENT DOCUMENTS

| | | | |
|---|---|---|---|
| 677854 | 1/1964 | Canada | 366/176.2 |
| 0458039A1 | 11/1991 | European Pat. Off. . | |
| 788038 | 10/1935 | France . | |
| 1113928 | 9/1961 | Germany | 366/176.1 |
| 3728946 | 6/1989 | Germany . | |
| 1577567 | 10/1980 | United Kingdom . | |

*Primary Examiner*—Charles E. Cooley
*Attorney, Agent, or Firm*—Arthur H. Rosenstein; Mark G. Bocchetti

[57] ABSTRACT

Described herein is an improved homogeniz head in which a variable orifice can be readily provided. The head (10) comprises a casing section (12) and a plug section (14). The casing section (12) has an internally threaded portion (120) which has a series of notches (126) formed in the threads (124). The plug section (14) has an externally threaded portion (14) which has a series of flats (154) formed on the threads (152). The two threaded portions (120, 140) are engaged and the cooperation of the notches (126) and flats (154) define homogeniz orifices through which the material being homogeniz passes. The orifices so formed are variable in size depending on the relative positioning of the notches (126) relative to the flats (154).

18 Claims, 18 Drawing Sheets

HOMOGENIZING APPARATUS

FIELD OF THE INVENTION

The present invention relates to homogenization heads and is more particularly, although not exclusively, concerned with homogenization heads for producing photographic dispersions.

BACKGROUND OF THE INVENTION

Homogenization is the process by which very small particles are produced from an initial coarse emulsion, suspension or dispersion to give a more stable emulsion, suspension or dispersion of smaller particle size. The process takes place in a valve or head wherein the coarse emulsion, suspension or dispersion is pumped through a small gap at high pressure. Due to the high pressure, the material being homogenized has a very high velocity and as a result a large pressure drop is experienced in the valve or head. Cavitation, turbulence and shear forces act to divide the coarse material into finer particles.

For example, if oil and water are to be homogenized to produce the smallest possible droplet size, a coarsely mixed liquid or 'premix' is passed through a high pressure homogenizer. In this process, the 'premix' may be pumped at pressures up to 1000 bar or even higher through a head wherein the pressure is reduced suddenly by a series of steps and narrow gaps back to atmospheric pressure. The high shear induced on the 'premix' causes the oil droplets to break up in a sequence of eddies, vortices, cavitations or impacts.

It has been found empirically that when homogenizing discrete phases of high viscosity, such as are found in photographic dispersions for example, then it is necessary to use an orifice type homogenizing system to produce the smallest droplet size. This type of homogenizing system comprises a plurality of orifice plates, each plate having at least one small hole formed therein and each plate is separated from an adjacent plate by spacers. As the 'premix' passes through the stack of plates, the dispersion is sequentially sheared. This type of homogenizing system provides a finer product than systems in which the liquid is forced between plates held together by an adjustable spring.

GB-A-1 577 567 describes such a system. A high pressure 'premix' is directed through a multi-stage device in which, at each stage, the material is directed through a nozzle at high speed and then impinges on a wall of an orifice block perpendicular to the direction of flow. The first break up and dispersion of the 'premix' occurs due to the shearing force exerted on the 'premix' as it passes through the nozzle. On impingement on the wall, the direction of flow of the 'premix' at high pressure is rapidly changed and a second break up and dispersion occurs. The material then flows through axially bored holes offset from the nozzle formed in the orifice block on to the next stage. A high degree of dispersion is obtained by the multi-stage effect.

However, with a fixed orifice homogenizing system, the pressure and flow are inseparably linked and one cannot be adjusted independently of the other. This is normally acceptable if the material being homogenized is made in a batch-wise fashion where the batch can be made under any reasonable pressure/flow conditions and stored prior to use.

DE-A-3 728 946 discloses a homogenizing head in which a piston-valve arrangement is used. Liquid to be homogenized is passed through an inlet formed in the valve seat at high pressure through a homogenizing channel defined by a piston and a valve seat each having a diamond-sintered layer. The valve has a surface which is angle at 5° to the end surface of the piston. Homogenizing material is then collected from a collection chamber through an outlet.

US-A-4 348 116 describes a homogenizing head arrangement in which a casing is provided with an internal cylindrical surface defining a bore, a portion of internal surface being threaded. The casing has an open end into which a rotatable closing plug is inserted, a portion of the outer surface of the plug being threaded for engagement with the threaded portion of the internal surface of the casing.

The casing also includes an inlet port through which the liquid to be homogenized is introduced and an outlet port through which the homogenized liquid can be collected. Longitudinally extending grooves or slots are provided along the threaded portion of the plug and extend to a depth which is more than the depth of the thread formed in the threaded portion, and cuts into the plug forming a continuous trench. These grooves or slots, which together with the threaded portions of the casing and the plug, define homogenizing passages through which liquid is directed under pressure from the inlet port. The homogenized liquid produced after passing through these homogenizing passages is then directed to the outlet port.

The bore in the casing has a first longitudinal axis, and the threaded portion is truncated in transverse section in a progressively variable fashion by providing a second bore having a second longitudinal axis which is displaced vertically from the first longitudinal axis. This means that the threaded portion of the internal cylindrical surface of the casing has threads which have an eccentric height on progressing a full turn around the internal surface of the casing. Rotation of the plug relative to the casing controls the variation of the section of the homogenizing passages. In particular, as the plug is rotated inside the casing through 180°, the edge of the threads of the thread inside the casing close in on the bottom of the trench formed in the plug to close the sequence of gaps between successive tetrahedral chambers so formed.

Problem to be Solved by the Invention

However, there are problems associated with the reproducibility of setting up this homogenizing head for operation. In particular, it is difficult to set it up to operate at particular high pressures. Furthermore, fluctuations in the flow rate may be obtained at settings at which the best dispersions would be expected.

The system described in GB-A-1 577 567 has the disadvantage that there is an inseparable link between pressure and flow as discussed above. Furthermore, such a system cannot be conveniently adjusted to identify an optimum orifice size or number of orifices for a given product. Moreover, no adjustment is possible to allow for small changes due to wear.

The device described in US-A-4 348 116 has unsupported thread portions due to the eccentricity of the second bore and these threads may be deformed when operating at the highest pressures. Moreover, a very accurate double boring operation is required in the manufacture of the casing to produce the truncated thread portions thus limiting the options for variation in geometry of the device.

SUMMARY OF THE INVENTION

It is therefore an object of the present invention to provide an improved homogenizing head which is simpler to manufacture and overcomes the problems associated with fluctuating flow rates and reproducibility of set up.

It is a further object of the present invention to provide a homogenizing head in which independent control of pressure and flow can be achieved.

In accordance with one aspect of the present invention, there is provided a homogenizing head comprising:

a casing portion having at least one open end, an inlet port, an outlet port and at least one internally threaded portion situated between the inlet port and the outlet port;

a plug portion having at least one externally threaded portion for engaging the at least one internally threaded portion of the casing portion as the plug portion is inserted into the casing portion; and channel defining means for defining at least one homogenizing channel across the engaged threaded portions of the casing portion and the plug portion, the channel defining means comprising at least a first region formed in the internally threaded portion of the casing portion and at least a second region formed on the externally threaded portion of the plug portion, each first and second region cooperating with one another to define a homogenizing channel, characterized in that one of the first or second regions comprises at least one notch portion formed on either the internally threaded portion of the casing portion or the externally threaded portion of the plug portion, each notch portion being cut to a depth which is less than the full depth of the threaded portion on which it is formed, and the other one of the first or second regions comprises at least one flat portion formed on respective ones of the internally threaded portion of the casing portion or the externally threaded portion of the plug portion, each flat portion being cut to a depth which is less than the full depth of the threaded portion on which it is formed, and in that each flat portion varies in height along its length around the circumference of the threaded portion on which it is formed, alignment of one flat portion with one notch portion defining a homogenizing channel, and depending on the relative position of the notch portion and the flat portion, the size of the homogenizing channel defined thereby can be continuously varied between a substantially fully open position and a substantially fully closed position.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
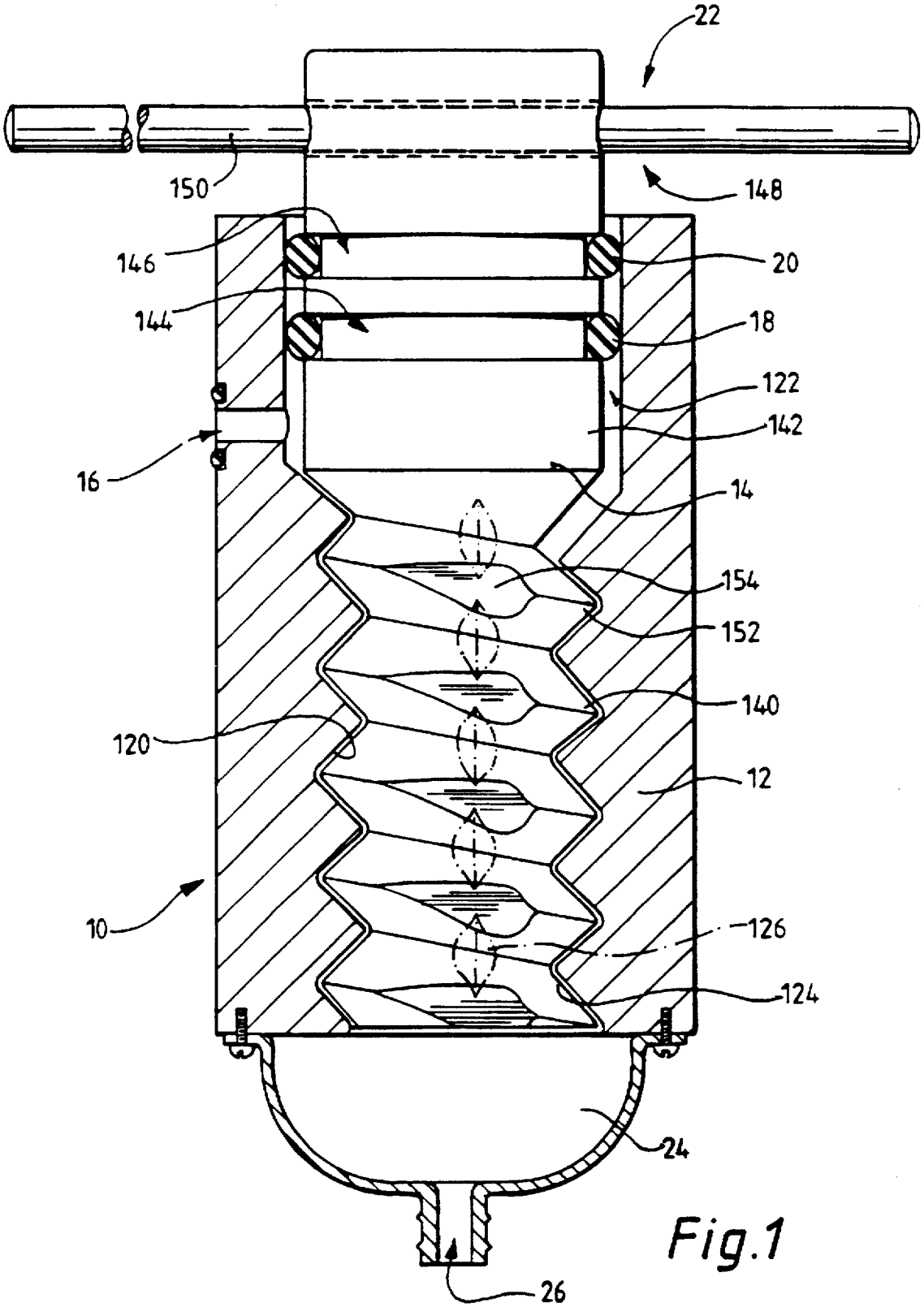
FIG. 1 is a schematic cross-section through one embodiment of a homogenizing head constructed in accordance with the present invention on an exaggerated scale.

FIG. 1 illustrates one embodiment of a homogenizing head 10 constructed in accordance with the present invention. The head 10 comprises a casing section 12 and a plug section 14. The casing section 12 has an internally threaded portion 120 and a housing portion 122. An inlet 16 is provided in the casing section 12 as shown. The plug section 14 has an externally threaded portion 140, which is sized for engagement with the internally threaded portion 120 of the casing section 12, and a shaft portion 142. Two annular grooves 144, 146 are formed in the shaft portion 142 in which O-ring seals 18, 20 are arranged to seal against the housing portion 122 as shown. Naturally, a different number of grooves may be provided to accommodate different numbers of O-ring seals according to the particular application. This seal system acts to close off the flow of liquid towards end 22 of the head 10. End 148 of the plug section 14 carries a bar portion 150 by means of which the plug section 14 can be rotatably inserted into the casing section 12 and then turned to alter the relative position of the plug section with respect to the casing section once inserted. The head 10 also includes a collection chamber 24 having an outlet 26.

The threads of the internally threaded portion 120 (female threads) and the externally threaded portion 140 (male threads) are axially symmetric. Each thread 124 of the internally threaded portion 120 of the casing section 12 has a notch 126 formed in it. Similarly, each thread 152 of the externally threaded portion 140 of the plug section 14 has a flat 154 formed on it. Each notch 126 and flat 154 is not cut to the bottom of its respective thread 124, 152. This enables a variable area orifice to be produced by changing the relative positions of the notches 126 and flats 154. The orifice defines a homogenizing channel through which material to be homogenized passes during the homogenization process.

Furthermore, as the notches 126 and flats 154 are cut only into a part of the depth of their respective threads 124, 152, in all relative orientations of the plug section 14 and the casing section 12, the male and female threads interlock securely over a substantial fraction of the depth of the threads, and liquid can flow through the well supported cavities so formed under high pressure.

In operation, a 'premix', that is, a coarse mixture of the components to be homogenized is directed at high pressure into the head 10 at its inlet 16. The 'premix' then passes through the homogenizing channels defined by the orifices formed by notches 126 and flats 154 in the engaged threaded portions 120, 140 to the collection chamber 24. Homogenizing of the 'premix' is achieved by the material passing through one orifice and into a larger chamber defined by the flat 154 in the plug section 14 and the associated threads 120 of the casing section 12. From there, the material then passes to the next orifice and larger chamber etc. The homogenized material can then be removed from the chamber 24 through the outlet 26.

Figure 2:
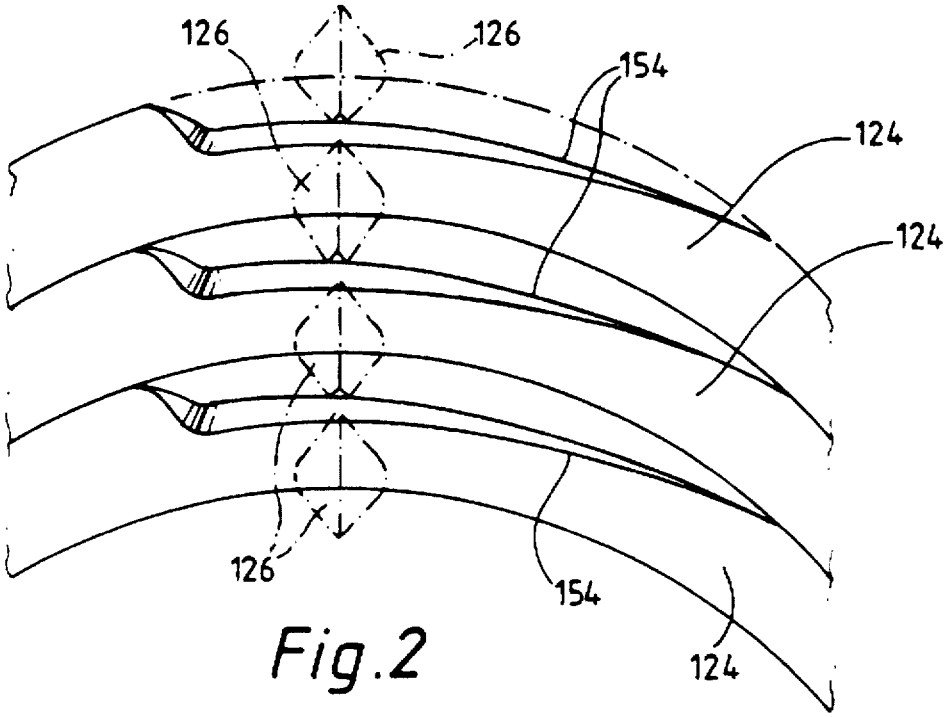
FIG. 2 is a schematic sectioned perspective view illustrating the cooperating flats and notches of in the homogenizing head shown in FIG. 1.

FIG. 2 shows schematically the relative positioning of the notches 126 and flats 154 in more detail. Each notch 126 is a fixed size and cooperates with a flat 154 which varies in depth along its length. When a notch 126 lies over a flat 154, an orifice is formed through which the 'premix' is directed at high pressure. The size of this orifice can be varied in accordance with the relative position of the notch 126 with respect to the flat 154, that is, the position of the notch 126 along the length of the flat 154.

Figure 3:
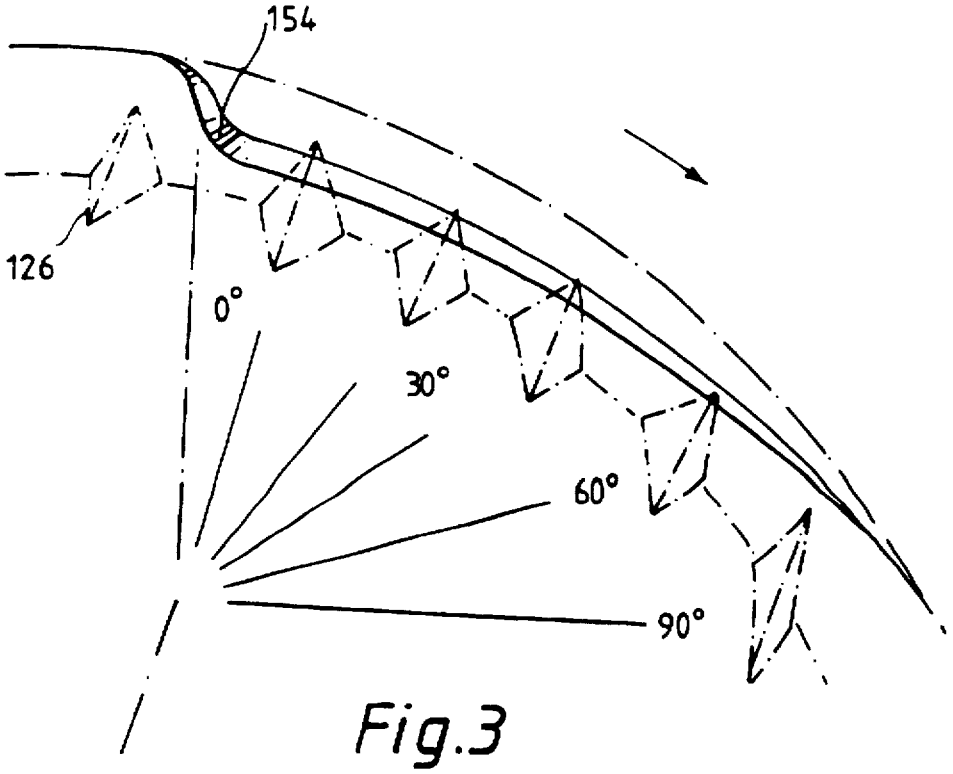
FIG. 3 is a more detailed view illustrating orifice size as defined by the cooperation of the notches and slots.

In FIG. 3, various positions of a notch 126 are shown relative to a flat 154. As shown, at 0°, the orifice will have its greatest size as a major part of the notch 126 overlies the lowest part of the flat 154. As the relative angle is increased, the orifice size decreases due to the notch 126 overlying higher parts of the flat 154. In this particular arrangement, the flat 154 varies in height over an angle of 90° and as a result, at a relative angle of 90°, the orifice is closed off entirely. However, other arrangements are possible where smaller or larger relative angles may be provided over which the orifice size can vary.

Figure 4:
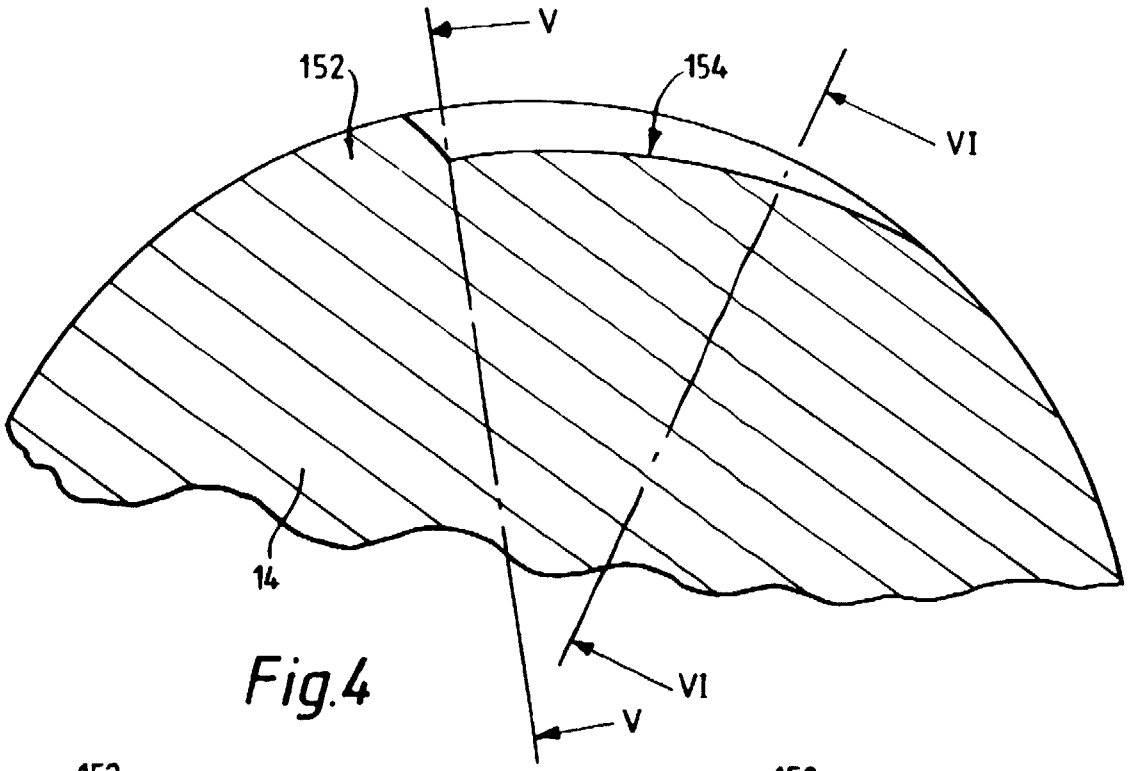
FIG. 4 illustrates a partial cross-section through a plug portion in accordance with the present invention.
Figure 5:
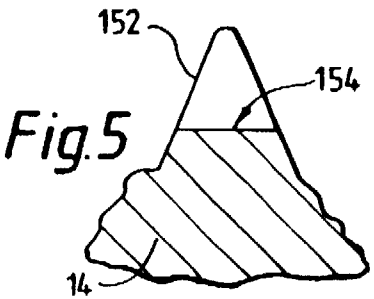
FIG. 5 is a sectioned view taken on lines V—V in FIG. 4.
Figure 6:
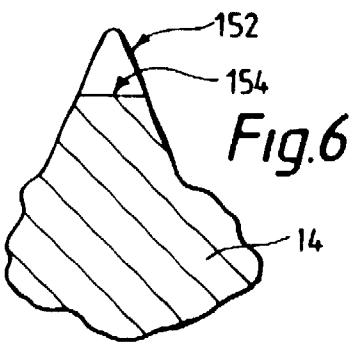
FIG. 6 is a sectioned view taken on lines VI—VI in FIG. 4.

Referring now to FIGS. 4 to 6, sections through a thread 152 are shown. In FIG. 4, plug section 14 is shown with a flat 154 formed on a thread 152. FIGS. 5 and 6 illustrate sections through the thread 152 at the positions shown by lines V—V and VI—VI respectively.

Figure 7:
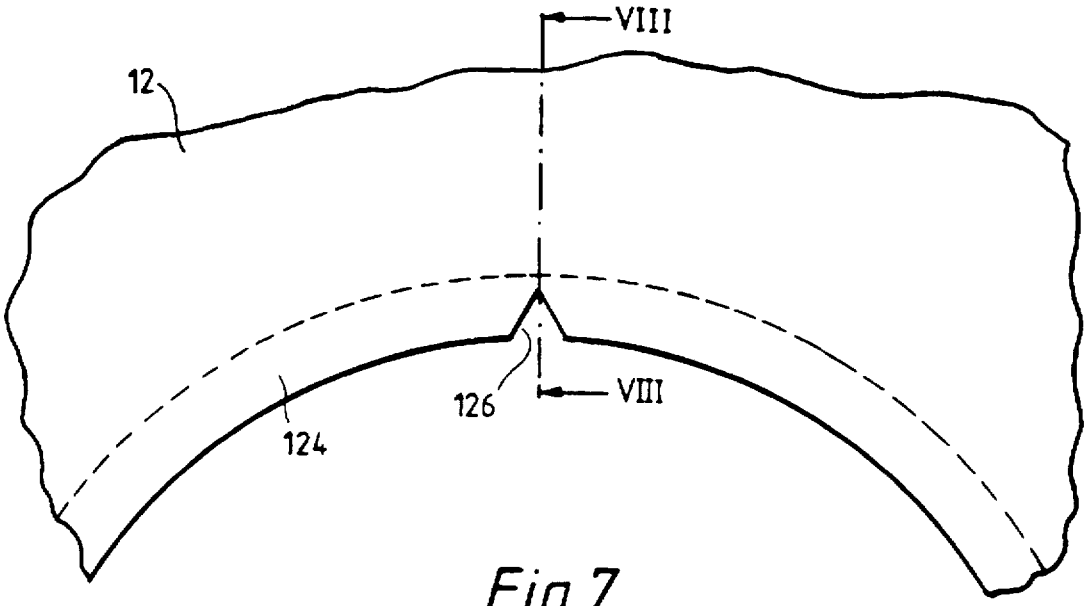
FIG. 7 illustrates a part of a casing portion in accordance with the present invention.
Figure 8:
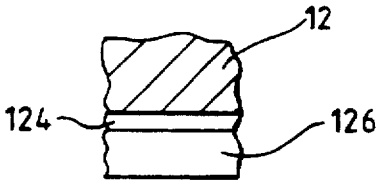
FIG. 8 is a sectioned view taken on lines VIII—VIII in FIG. 7.

Similarly, in FIGS. 7 and 8, sections through a thread 124 are shown. FIG. 7 shows casing section 12 with a notch 126 formed on a thread 124. FIG. 8 illustrates a section through the thread 124 at the line VIII—VIII.

FIGS. 9 to 12 are sections through the head 10 with notch 126 aligned along flat 154 at different relative positions. Dotted line 30 marks the position of the notch 126 in each case.

Figure 9:
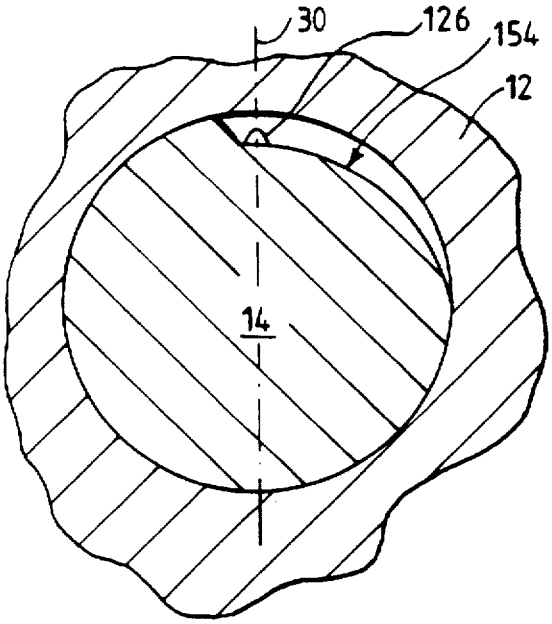
FIGS. 9 to 12 illustrate respective enlarged and exaggerated cross-sections through the homogenizing head in accordance with the present invention showing the notch of the casing portion aligned with different regions of the flat of the plug portion.
Figure 10:
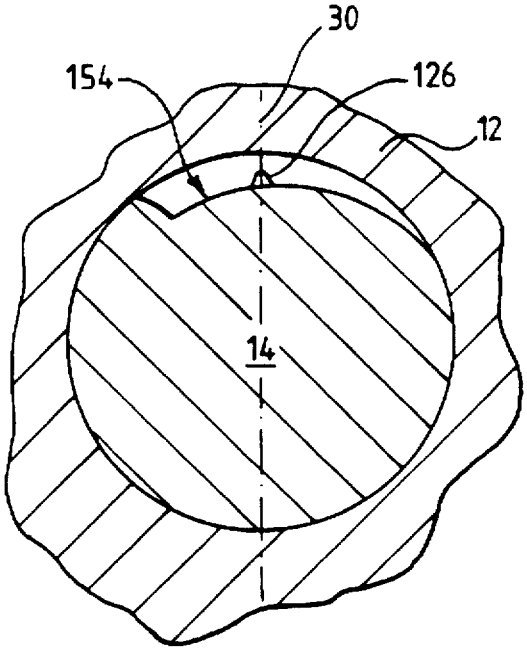
Figure 11:
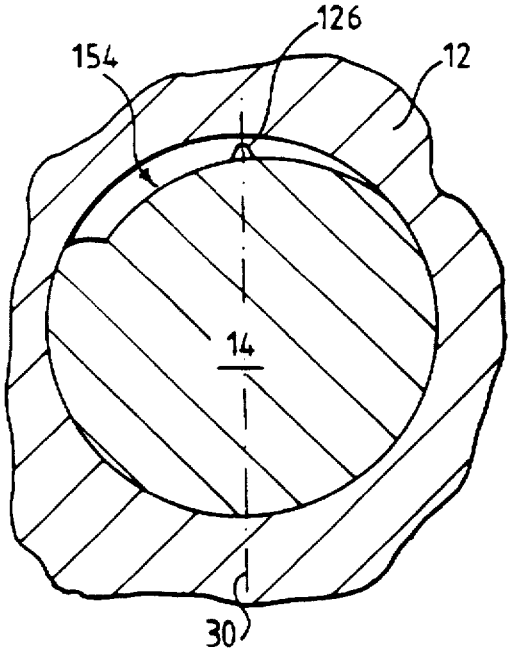
Figure 12:
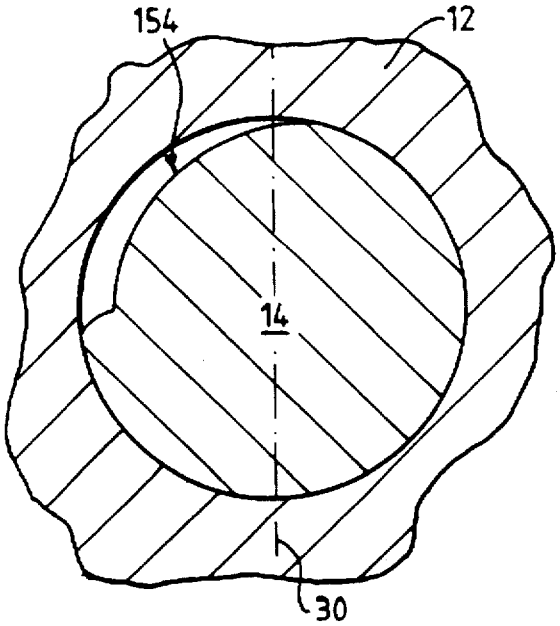

In FIG. 9, the angle between the notch 126 and the flat 154 is 0°. Here, the orifice is fully opened as described previously. As the flat 154 is moved relative to the notch 126 to an angle of 30° (as shown in FIG. 10), the orifice becomes smaller. At the 60° position, shown in FIG. 11, the orifice is smaller still and is finally closed in the 90° position shown in FIG. 12.

In the embodiment of the plug section 14 described above, five threads 152 have been shown with flats 154 extending around a quarter of the circumference (90°) of each thread 152. Naturally, different lengths can be given to the flat 154 depending on the particular application.

Figure 13:
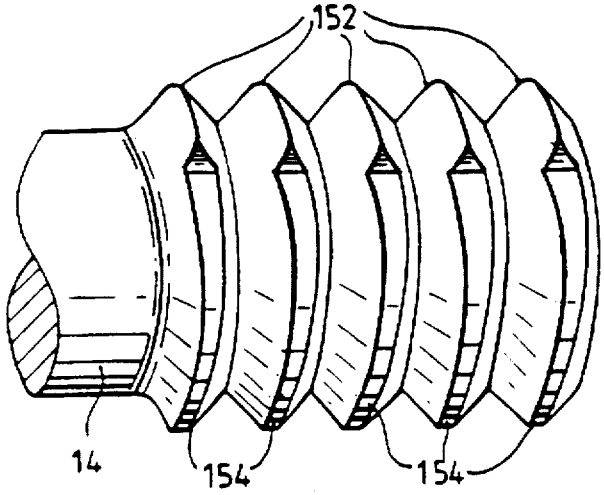
FIG. 13 illustrates a plug section having flats which extend around half its circumference.

FIG. 13 illustrates a part of a plug section 14 in which the flats 154 extend around half the circumference of the thread 152, that is, through an angle 180°. In this case, the orifice would be open at the 0° position as before, but would not be closed off until the 180° position. Further extension of the flats to almost the entire circumference of the thread may be possible to provide finer control over a wider range of angles.

It will be readily appreciated that there may be more or less than five threads formed on the plug section 14 according to the particular homogenizing application.

Furthermore, not all the threads need be engaged. This has the effect of cutting down the number of orifices through which the material being homogenized passes during the homogenizing process.

Figure 14:
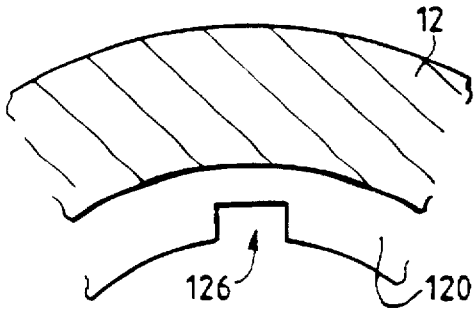
FIGS. 14 to 17 illustrate notches of different cross-section.
Figure 15:
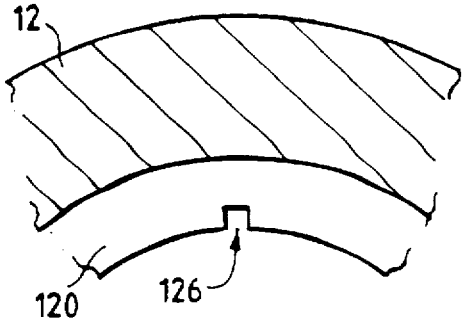
Figure 16:
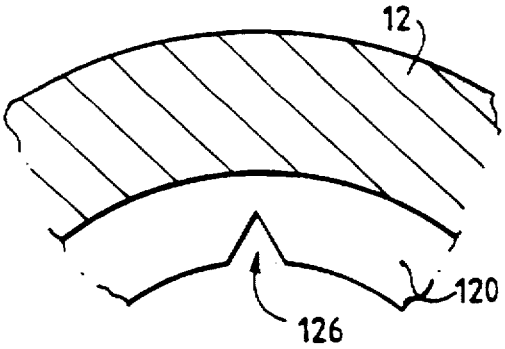
Figure 17:
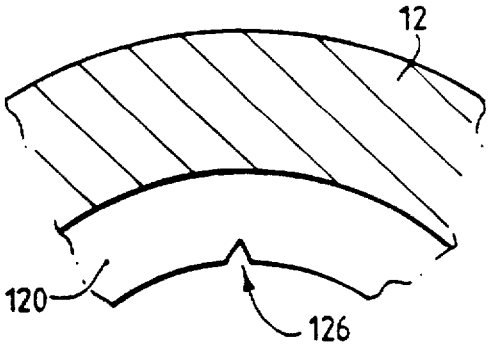
Figure 18:
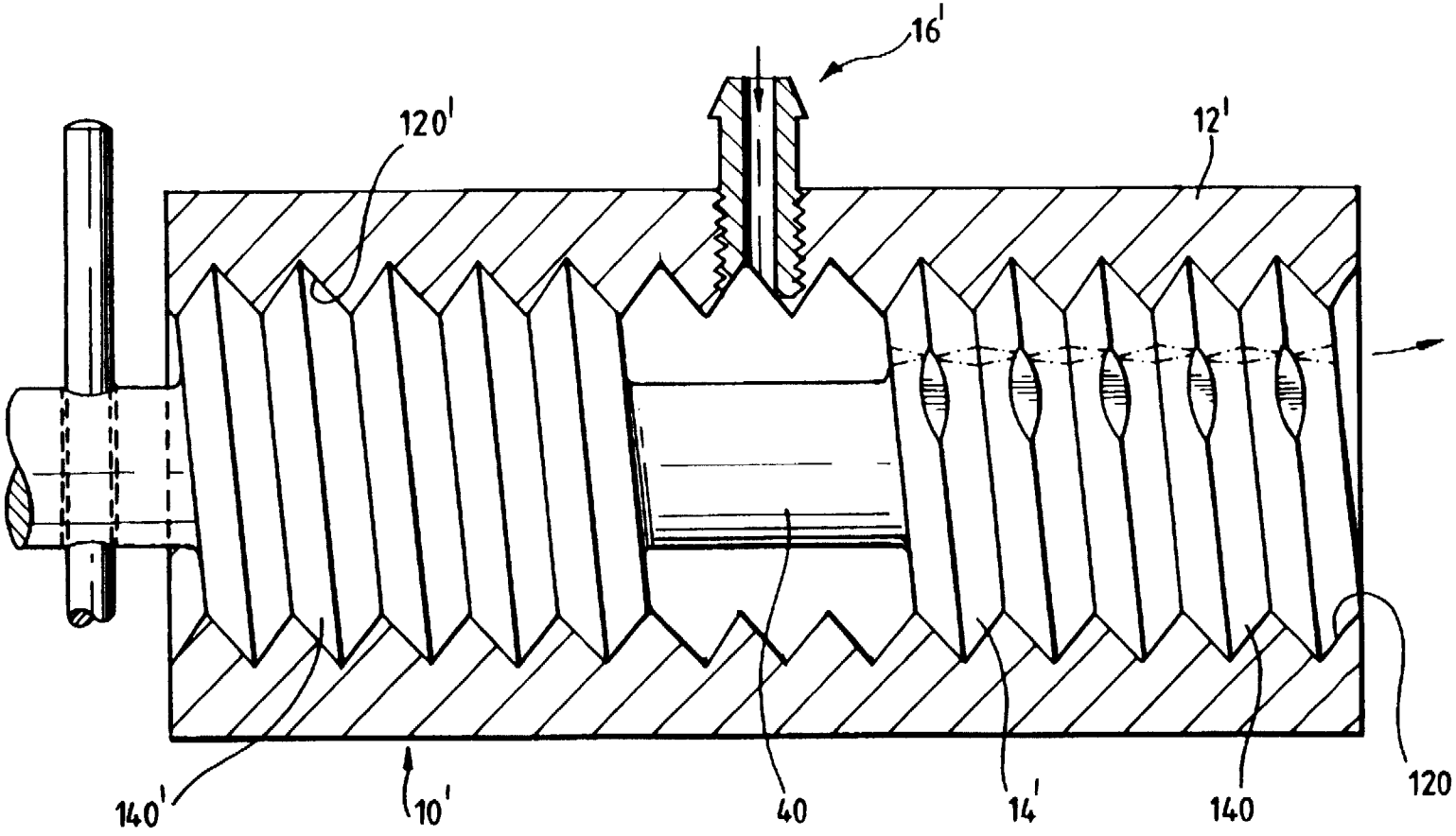
FIG. 18 illustrates a schematic cross-section through a second embodiment of a homogenizing head constructed in accordance with the present invention.

As shown in FIGS. 14 to 17, the notch 126 may have different cross-sections. The notch 126 need not be triangular as described above and may have a rectangular cross-section as shown in FIG. 14 or a square cross-section as shown in FIG. 15. Moreover, the notch 126 may vary in cross-section over several threads from a size shown in FIG. 16 to that shown in FIG. 17 and vice versa. This would have the effect of having progressively sized orifices.

In a second embodiment of a homogenizing head 10' in accordance with the present invention, a second internally threaded portion 120' may be provided in casing section 12', and a second externally threaded portion 140' provided in plug section 14'. These two portions 120', 140' are not provided with notches and flats in a similar way to portions 120, 140, but are present to balance the pressures applied to the head 10'. Portions 120', 140' carry out a similar function to the 'O' ring seals described with reference to FIG. 1. Threaded portions 120', 140' may be cut to a different diameter but have identical pitches to threaded portions 120, 140. Portion 140' is connected to portion 140 by a 'waisted' or shaft portion 40. This head 10' operates as described above.

It will be appreciated that the flats and notches described above may be interchanged and provide the same effect, that is, the notches may be cut in the plug section and the flats in the casing section.

Although the present invention has been described with reference to embodiments in which a single flat/notch is provided on each thread, it may be the case where two or more evenly spaced flats/notches are utilized. Flow of the 'premix' through the head may be substantially increased.

The flats may have any suitable profile. However, the profile described above, that is, the depth changing along the length, has the advantage that positioning is not duplicated and that there is opportunity for extending adjustments over a greater arc than would be the case if the flat were not varying in height around the circumference of the thread 152.

The notches and flats described above are axially aligned with the longitudinal axes of both the casing section 12 and the axis of the plug section 14. It may be advantageous to align the notches and/or flats so that they are skewed with respect to the longitudinal axes providing a more tortuous path for the material as it passes through the homogenizing head.

It may also be advantageous to modify the notch/flat arrangement to incorporate a feedback system to compensate for fluctuations in pressure of the 'premix'. This has the effect of maintaining a more constant product, that is, constant droplet size and/or reactivity. For example, the feedback system may be provided by angling the notches relative to the flats such that the 'premix' passing through the notch impinges on a portion of the flat to move the casing section 12 relative to the plug section 14 against an opposing torque.

Heads according to the present invention may be made from stainless steel which has high corrosion resistance and is relatively easy to clean. Contamination of the product is also reduced. However, if the head is to be used in situations where the casing section and the plug section are to be forced together under high pressure (stainless steel having a tendency to bind under these conditions), it may be necessary to plate at least one of the two sections to improve the slip of one surface over the other thereby preventing binding. An example of such plating would be electroless nickel plating. For example, the plug section could be made very slightly undersize and then a very thin layer of nickel plated on to its surface. This is advantageous as nickel is a hard metal and has good corrosion resistance.

Heads according to the present invention may be made from materials other than stainless steel. For example, ceramic materials can be used for either one or both sections of the head.

Furthermore, other surface treatments may also be used, for example, hardening and diamond coating.

A homogenizing arrangement was constructed using a head in accordance with the present invention as described above. The head was attached homogenizing apparatus sold by APV Rannie AS of Albertslund, Denmark (Lab type 16-51H), and experiments were carried out.

Experiment 1

Figure 19:
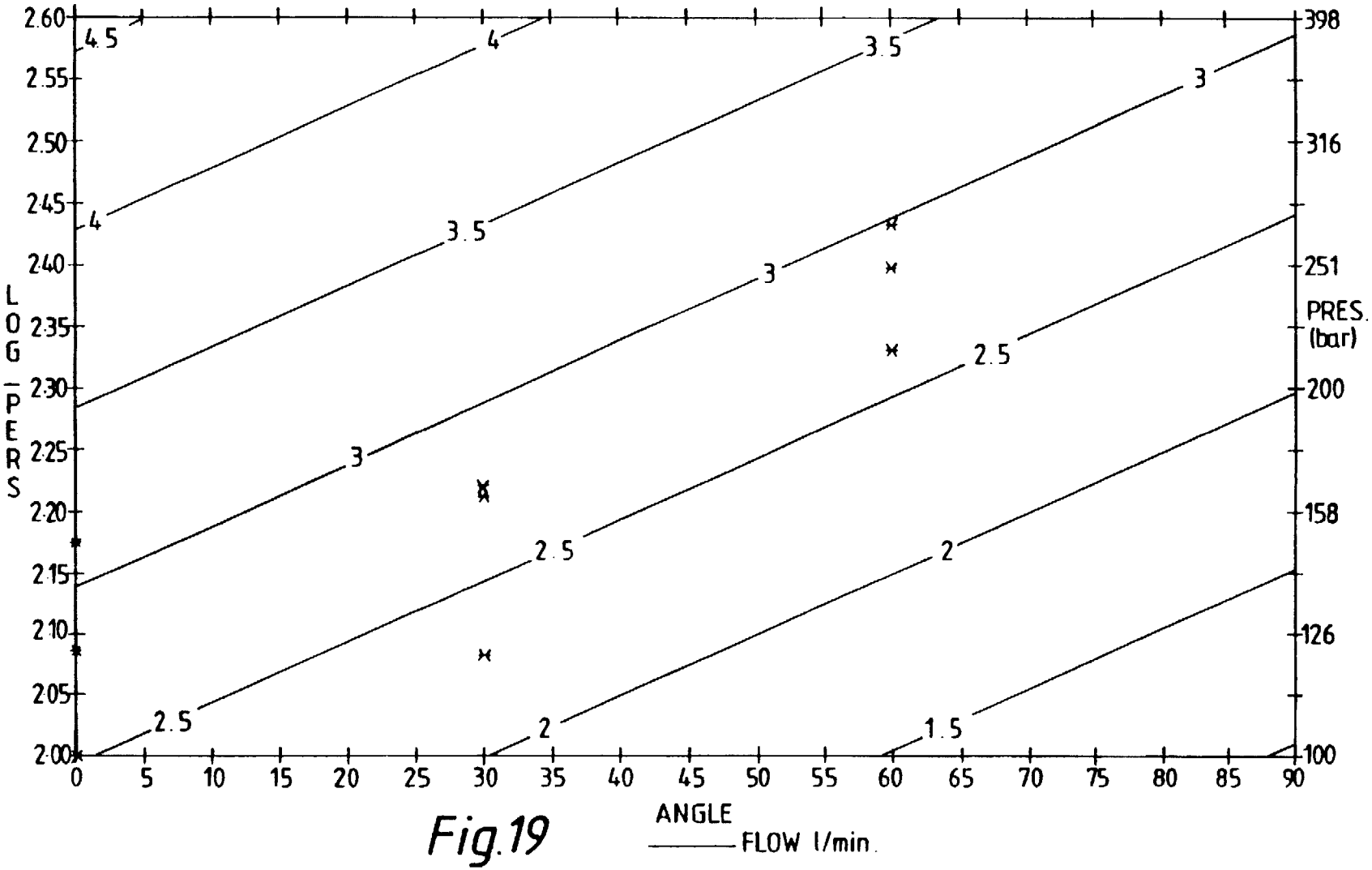
FIG. 19 is a graph showing water calibration of the homogenizing head of the present invention and illustrating the effect of pressure and angle on flow.

In this experiment, pressure/flow relationship through the head was to be determined. Water was used as the liquid for simplicity. The position of the flats with respect to the notch was varied over an angle of about 90°. The pressure was varied over about 150 bar (15 MPa). A range of pressure/flow/angle values were obtained and converted to a contour plot of flow with pressure on one axis and angle on the other. The plot obtained is shown in FIG. 19. From this, it can be seen that with a constant pressure, it is possible to obtain a flow varying over about 1.5 l/min for an angle variation of about 90°.

Experiment 2

In this experiment, a photographic dispersion was used. A premix of an Ektacolor (Registered Trade Mark) dispersion with about 8% gelatin was passed through the head using a range of pressures, flows and different angles. It was found that a wide range of reactivities could be obtained for a range of angles and pressures.

The results obtained from this experiment are given in Tables 1 and 2 below.

TABLE 1

| pressure (bar) | reactivity | droplet size |
|---|---|---|
| 172 | 911 | 0.5398 |
| 202 | 1070 | 0.4601 |
| rough extrapolation to 300 | 1500 | 0.22 |

TABLE 2

| screw angle at 300 bar (°) | reactivity |
|---|---|
| 90 | 553 |
| 60 | 848 |
| extrapolation to 30 | 1143 |

(Screw angle is the relative angle between the plug section and casing section as described with reference to FIGS. 9 to 12 above.)

It was noted that the reactivity increased as the orifice was opened. This implies that there may be an optimum size of orifice for a given system, and it can also be seen that the droplet size decreases as the pressure is increased. This is also shown graphically in FIGS. 20 and 24 described below.

Figure 20:
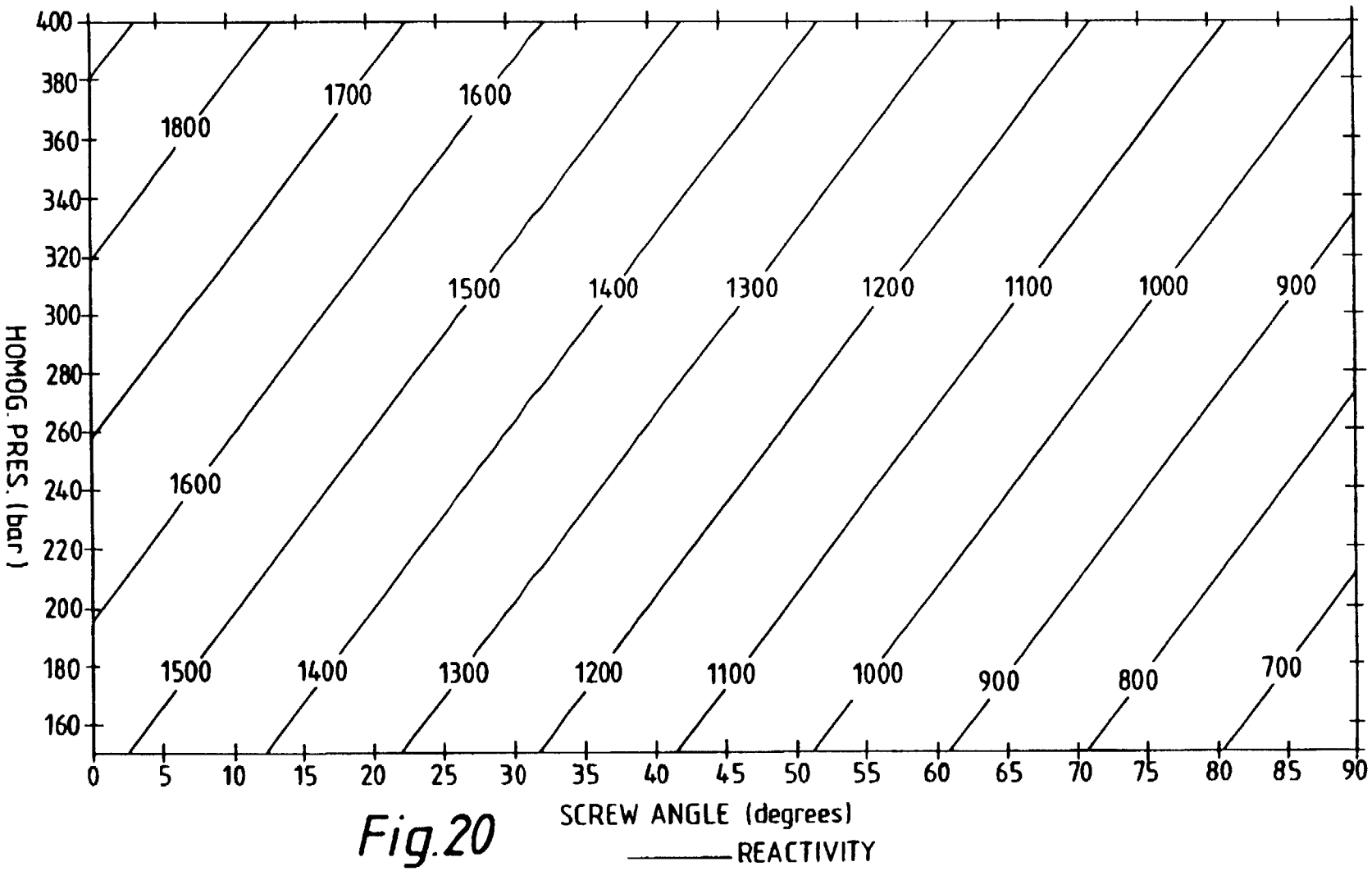
FIG. 20 is a graph showing contours of reactivity for a photographic dispersion at given pressures and angles.

Using other collected during the trials, a contour plot relating relative angle and pressure was obtained. This plot is shown in FIG. 20. It was apparent that with modest pressures and smaller angles, an appropriate reactivity level could be attained.

Figure 21:
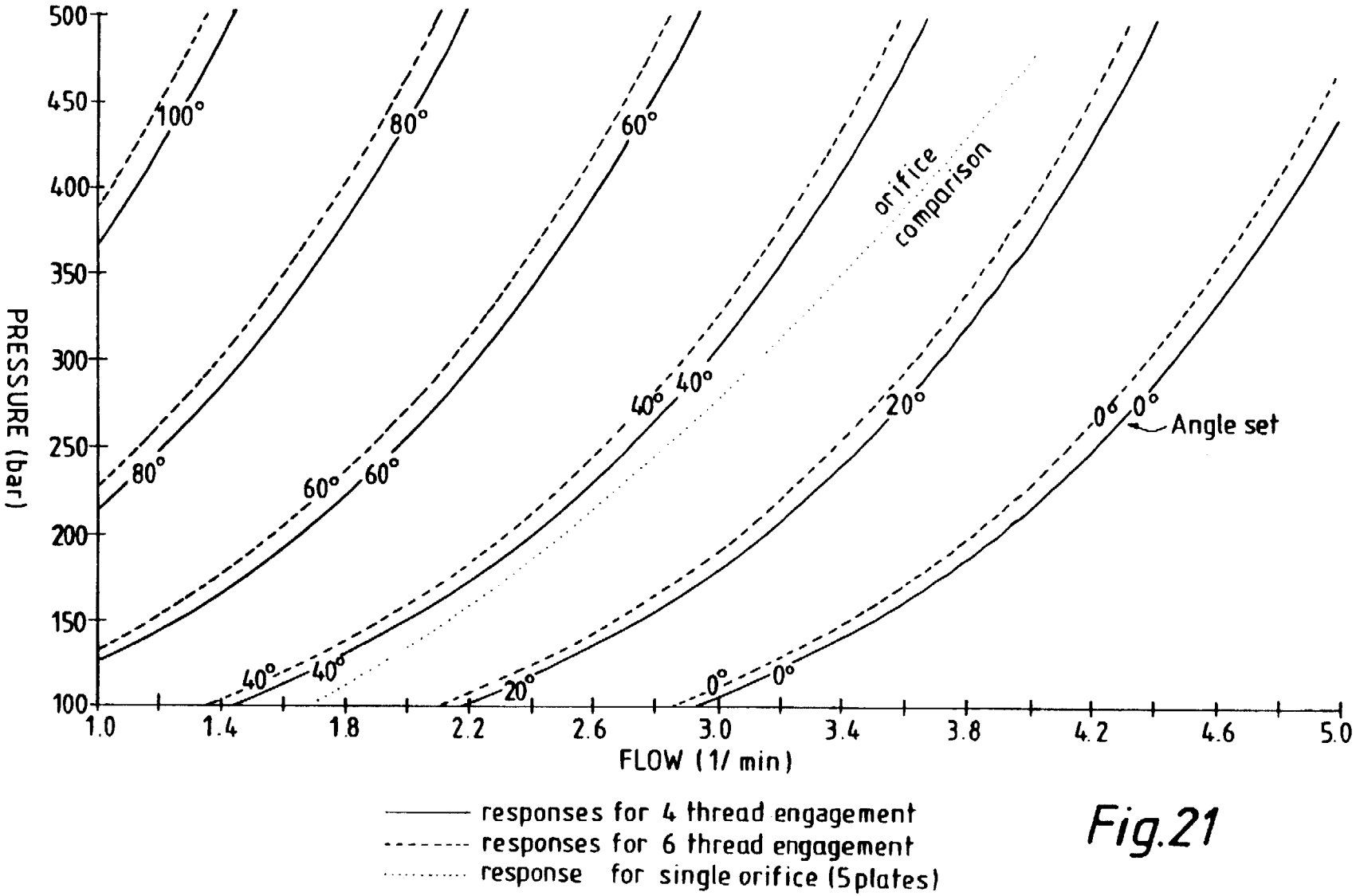
FIG. 21 is a graph illustrating the pressure/flow relationship for a photographic dispersion for a range of angles in the device according to the present invention.

FIG. 21 shows a plot of pressure against flow for particular screw angles. The solid and dashed lines respectively indicate the results obtained for a four-thread engagement and for a six-thread engagement. A comparison with a single orifice system having five plates is shown by the dotted line.

Figure 22:
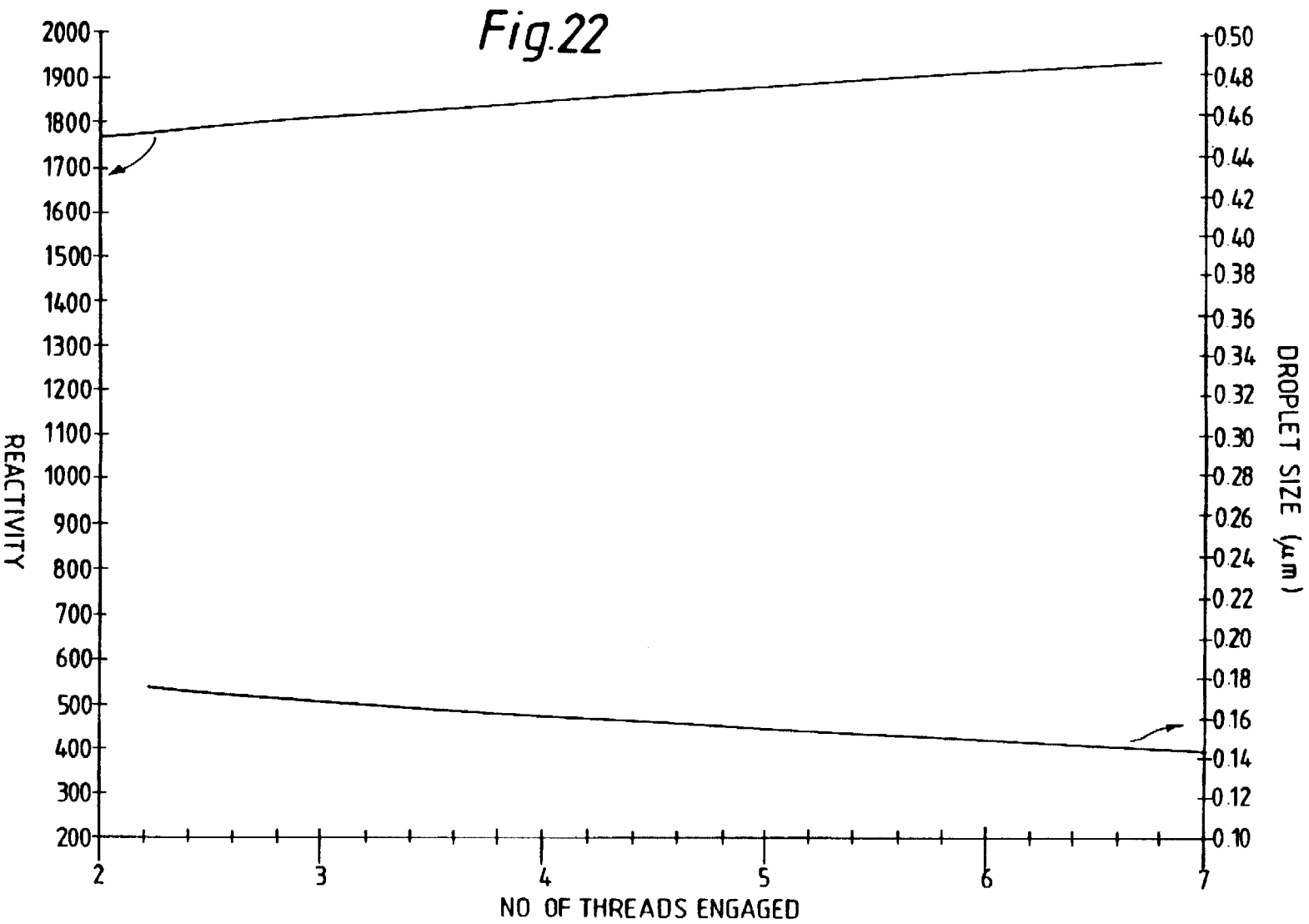
FIG. 22 is a graph illustrating the effect of changing the number of engaged threads on reactivity and droplet size for a photographic dispersion for a device according to the present invention.

FIG. 22 shows the effect of the number of engaged threads on reactivity and droplet size. As shown, by increasing the number of threads engaged from 3 to 6, the reactivity increases by approximately 100 units. Similarly, droplet size decreases by 0.02 μm as the number of threads engaged increases from 3 to 6.

Figure 23:
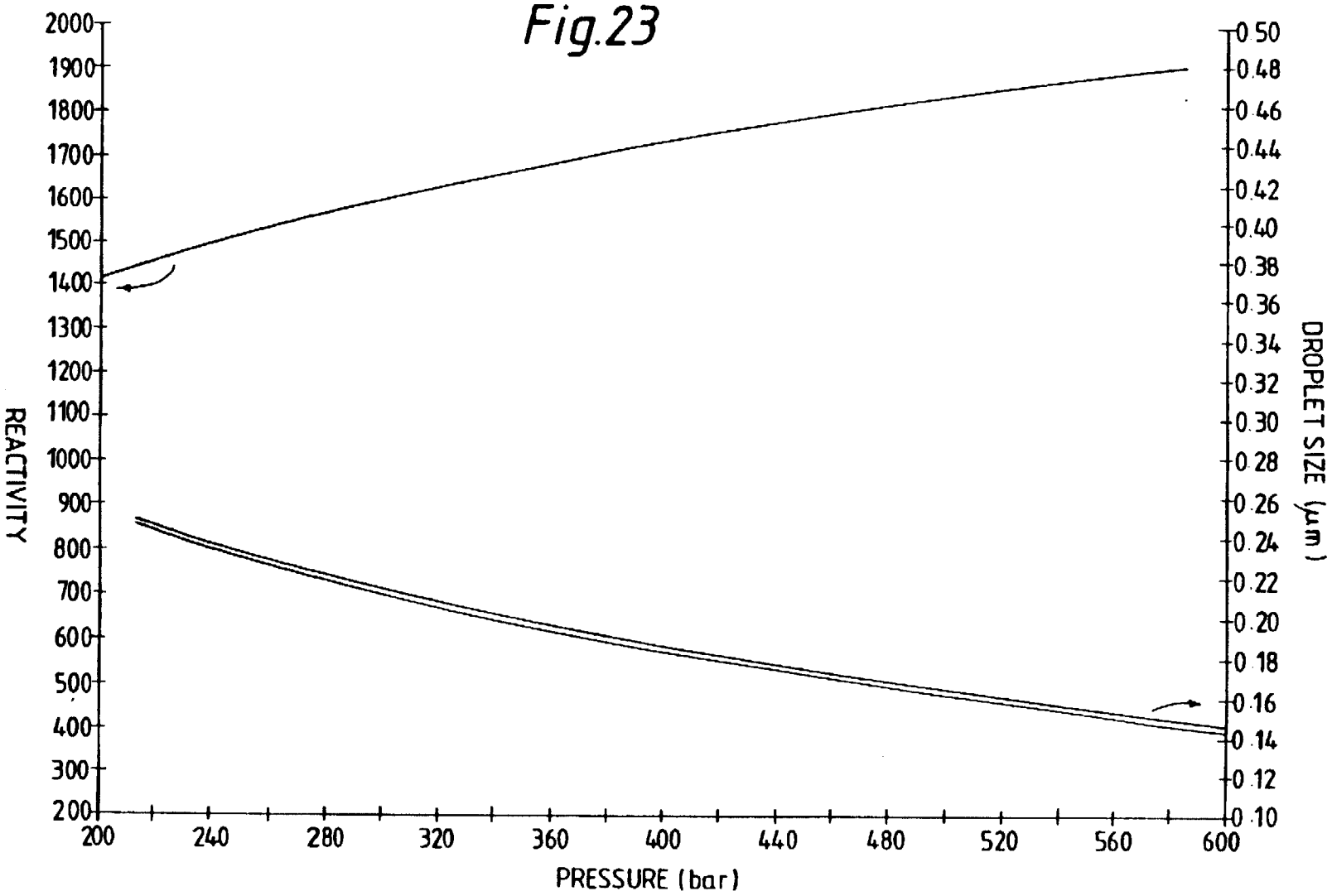
FIG. 23 is a graph illustrating the effect of pressure on reactivity and droplet size for a device according to the present invention wherein four threads are engaged.

FIG. 23 shows the effect of homogenizing head angle and pressure on reactivity and droplet size for a device having four engaged threads. The screw angle for the device according to the present invention was 0°.

Figure 24:
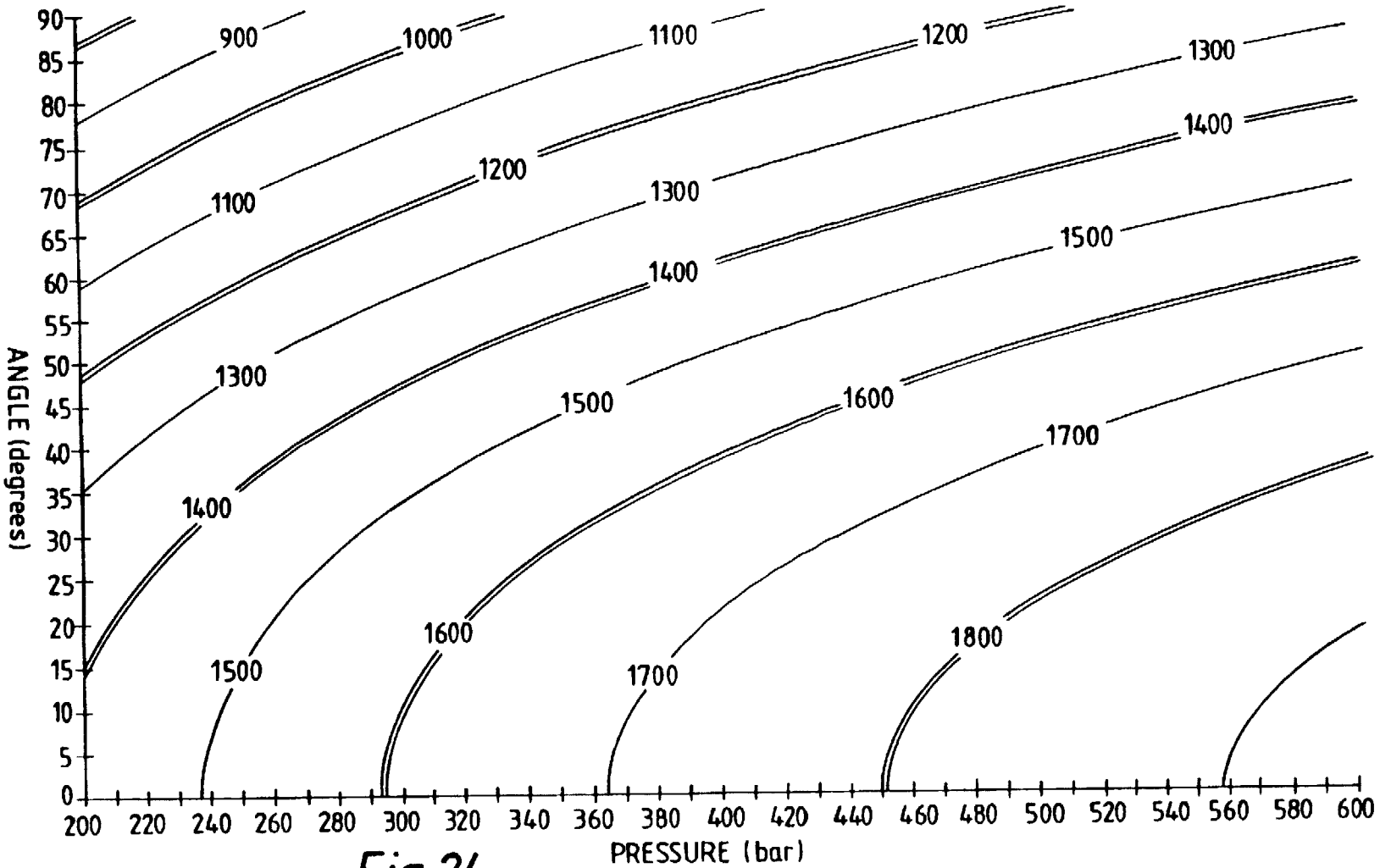
FIGS. 24 and 25 are graphs illustrating the effect of homogenizing device angle and pressure on reactivity and droplet size respectively.
Figure 25:
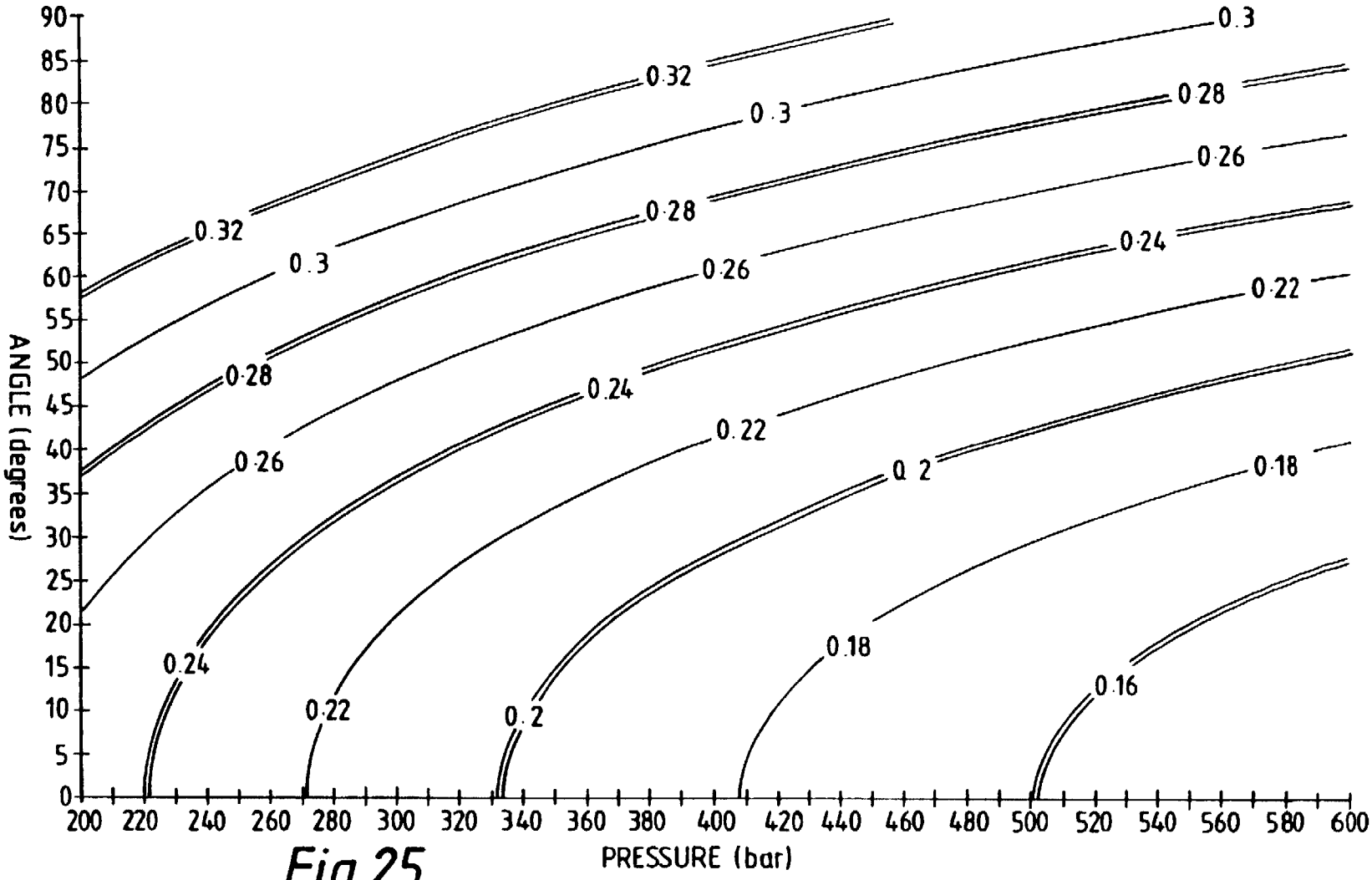

FIGS. 24 and 25 are plots which illustrate the effect of homogenizing head angle and pressure on reactivity and droplet size respectively.

Figure 28:
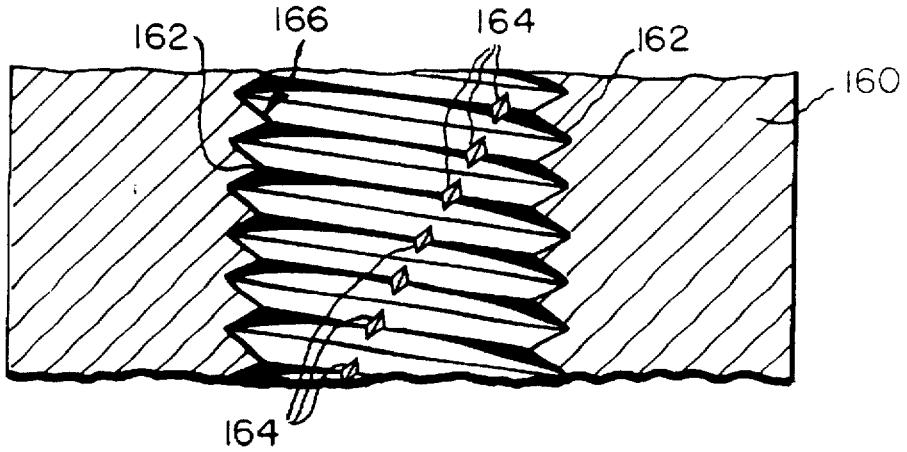
FIG. 28 is a schematic cross-section of an alternative embodiment of the casing section depicted in FIG. 1.

Turning next to FIG. 28, there is shown a casing section 160 which is an alterantive embodiment to the casing section 12 depicted in FIG. 1. Casing section 160 is essentially identical to casing section 12 with the exception that each thread 162 has a notch 164 formed therein where notches 164 form a line which is skewed with respect to the longitudinal axis of the threaded portion 166.

Figure 29:
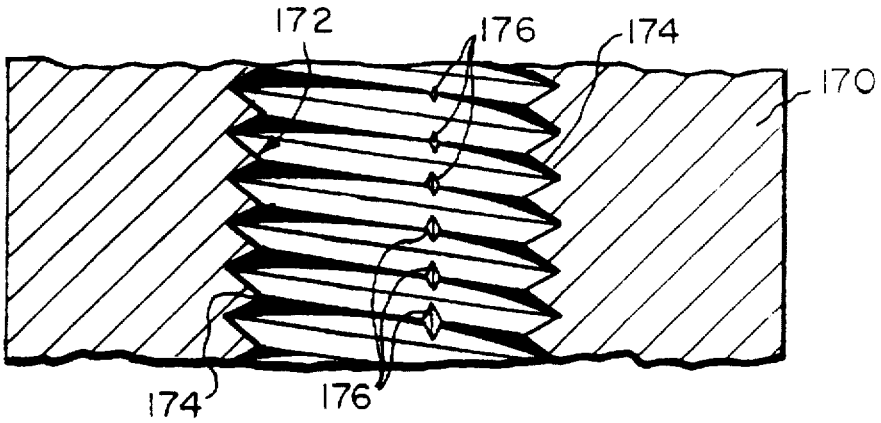
FIG. 29 is a schematic cross-section of a second alternative embodiment of the casing section depicted in FIG. 1.

FIG. 29 depicts a casing section 170 which is an alternative embodiment to casing sections 12, 160. Casing section 170 includes an internally threaded portion 172 comprised of a plurality of threads 174. There is a notch 176 in each thread 174. The size of each notch 176 increases along the length of the internally threaded portion 172.

Figure 30:
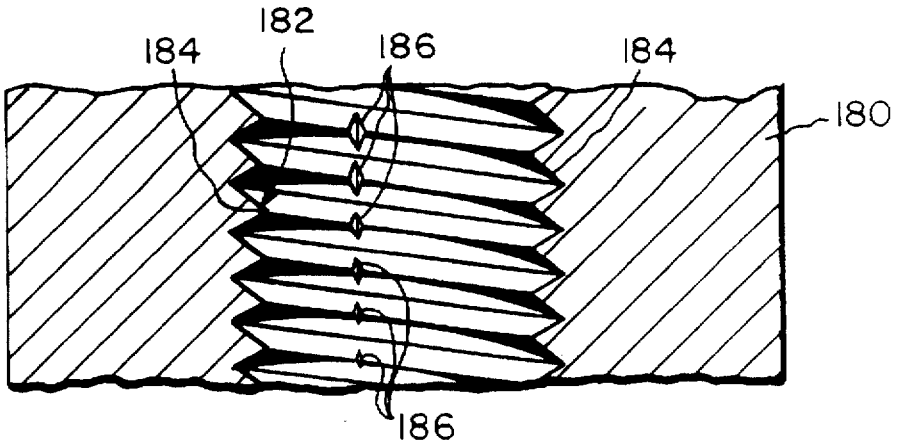
FIG. 30 is a schematic cross-section of a third alternative embodiment of the casing section depicted in FIG. 1.

FIG. 30 depicts a casing section 180 which is still another alternative to casing sections 12, 160, and 170. Casing section 180 includes an internally threaded portion 182 comprised of a plurality of threads 184. There is a notch 186 in each thread 184 with each notch 186 decreasing in the size along the length of the internally threaded portion 182.

Figure 31:
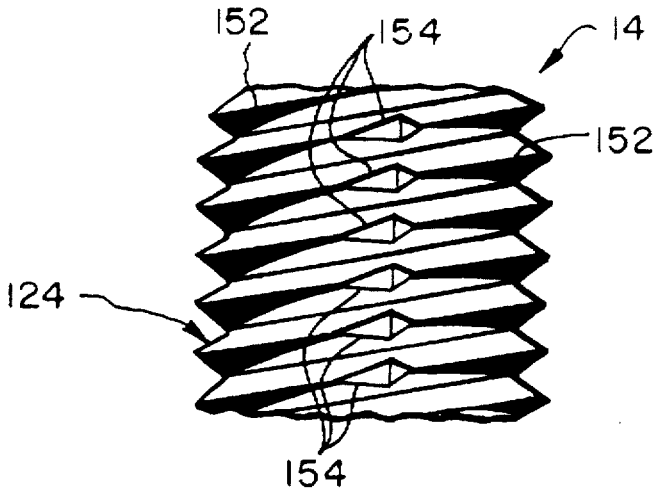
FIG. 31 is a side elevation of the plug portion of the homogenizing head depicted in FIG. 1.

FIG. 31 depicts part of the externally threaded portion 140 of plug section 14. The externally threaded portion 140 includes a plurality of threads 152 with a flat 154 cut in each thread 152. Note that the flats 154 form a line which is substantially aligned with the longitudinal axis of the externally threaded portion 140.

Figure 32:
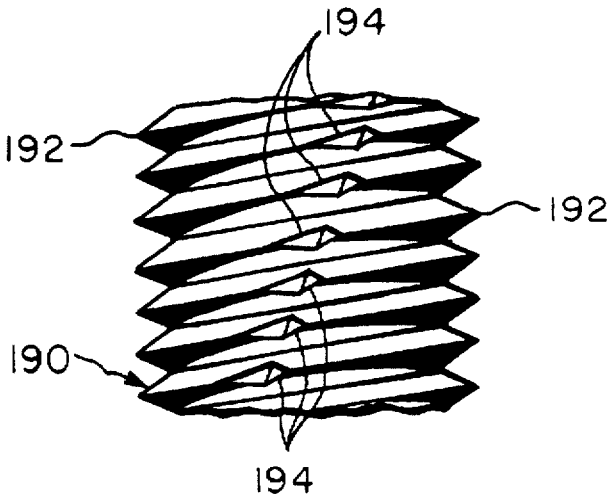
FIG. 32 is a side elevation of an alternative embodiment of the plug portion depicted in FIG. 31.

FIG. 32 depicts part of an externally threaded portion 190 which is an alternative embodiment to the externally threaded portion 124 depicted in FIGS. 1 and 31. Externally threaded portion 190 includes a plurality of threads 192 with a flat 194 formed in each thread 192. The flats 194 form a line which is skewed with respect to the longitudinal axis of the threaded portion 190.

As shown in FIGS. 24 and 25, it is clear that better reactivity values and smaller droplet sizes are obtained with high pressures and low screw angles. It is also to be noted that there is much less change in reactivity and droplet size with small pressure changes at small screw angles. This may define a robust region compared to the small orifice region (screw angles around 90°) where similar small changes in pressure result in large changes in reactivity and droplet size respectively.

Figure 26:
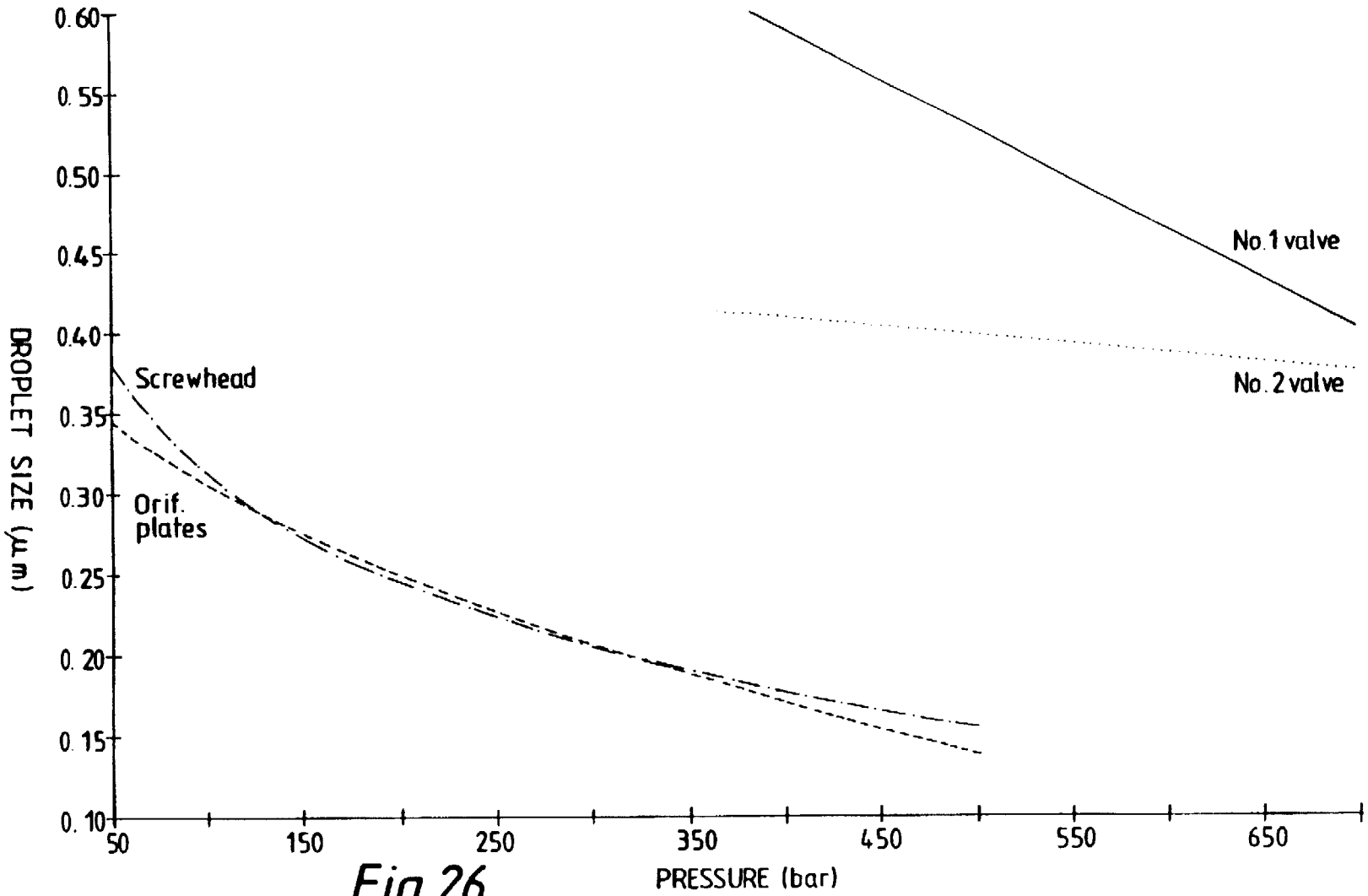
FIGS. 26 and 27 are graphs illustrating the effect of pressure on droplet size and reactivity respectively for four different homogenizing heads.
Figure 27:
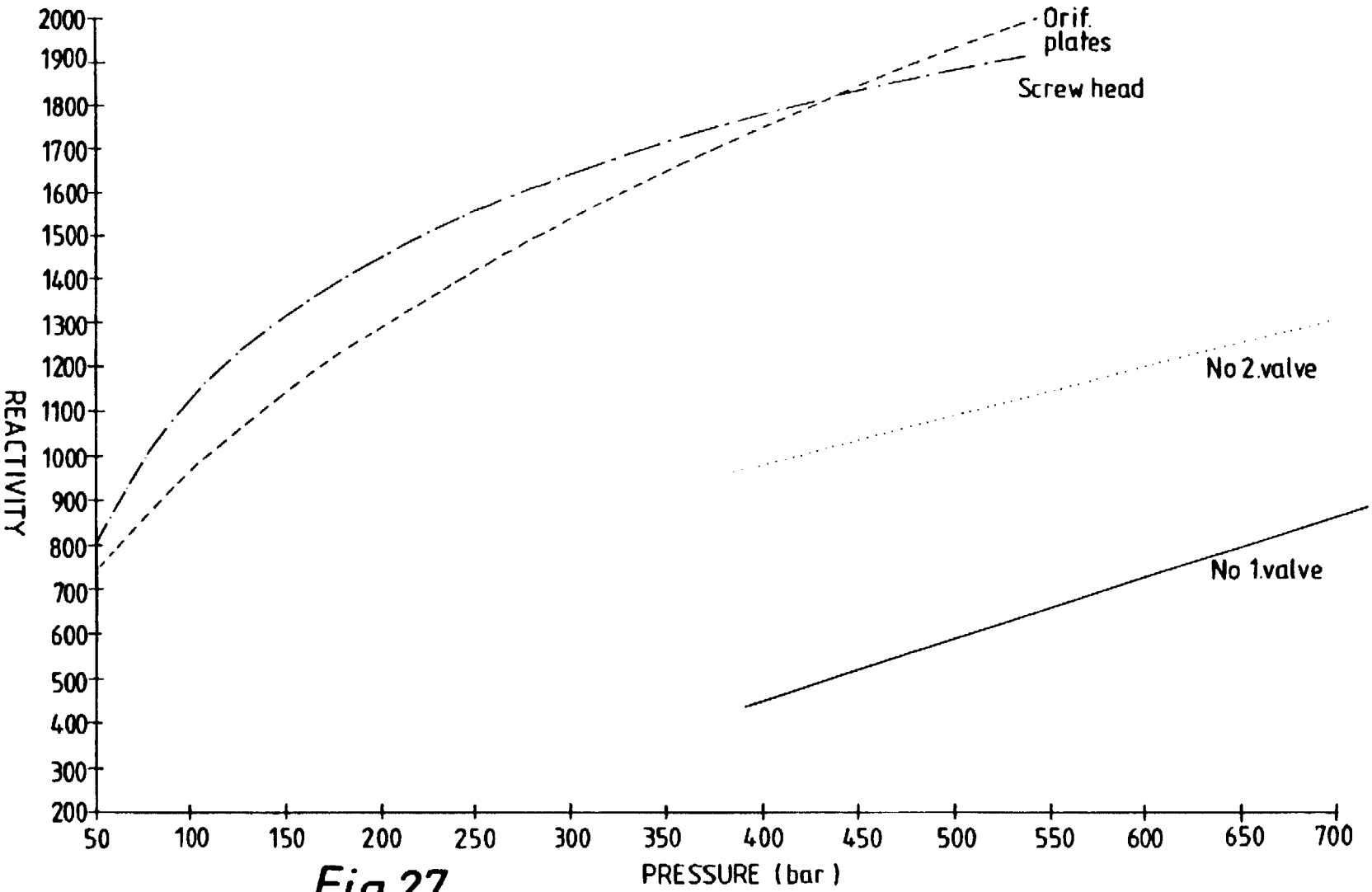

FIGS. 26 and 27 show the comparison between two spring-loaded valve heads (shown as solid (No. 1) and dotted (No. 2) lines respectively), fixed orifice plates (shown as a dashed line) and the device according to the present invention (shown as a dot-dashed line) for the effect of pressure on droplet size and reactivity respectively.

As shown in the Figures illustrating the test results obtained with the device of the present invention, the properties of the dispersion, namely, reactivity and droplet size, can be controlled by the number of orifices through which the material passes during homogenization, the homogenization pressure, and the size of the orifice or screw angle.

It is to be noted that the present invention can be used for other dispersions and is not limited to use with photographic dispersions. Naturally, the dimensions and configuration of the homogenizing head are chosen in accordance with the particular application for which it is to be used.

What is claimed is:

1. An apparatus for homogenizing a liquid comprising:

a casing portion having an inlet port, an outlet port and at least one internally threaded portion situated between the inlet port and the outlet port;

a plug portion having at least one externally threaded portion for engaging the at least one internally threaded portion, the plug portion being rotatable relative to the casing portion and being threadably engaged with the casing portion to yield at least one threadably engaged section, a channel defining means for defining at least one homogenizing channel across the at least one threadably engaged section, the channel defining means comprising at least one first region formed in the internally threaded portion and at least one second region formed on the externally threaded portion, the at least one first region cooperating with the at least one second region in the at least one threadably engaged section such that through rotation of the plug portion the at least one homogenizing channel can be varied between a fully open position and a fully closed position.

2. An apparatus as recited in claim 1 wherein:

the at least one internally threaded portion includes at least one first thread, the at least one first region being a notch formed in the at least one first thread, each notch being cut to a depth which is less than a full depth of the at least one first thread.

3. An apparatus as recited in claim 2, wherein:

the at least one externally threaded portion includes at least one second thread, the at least one second region being a flat formed in the at least one second thread, each flat being formed to a depth which is less than a full depth of the at least one second thread.

4. An apparatus as recited in claim 3 wherein:

the at least one externally threaded portion includes a plurality of threads, the respective flats in each of the plurality of threads forming a line which is parallel to a longitudinal axis of the at least one externally threaded portion.

5. An apparatus as recited in claim 3 wherein:

the at least one internally threaded portion includes a plurality of threads, the respective flats in each of the plurality of threads forming a line which is skewed from a longitudinal axis of the at least one externally threaded portion.

6. An apparatus as recited in claim 3 wherein:

the at least one externally threaded portion includes a plurality of threads, each flat in each of the plurality of threads varying in depth along a length thereof.

7. An apparatus as recited in claim 2 wherein:

the at least one internally threaded portion includes a plurality of threads, the respective notches in each of the plurality of threads forming a line which is parallel to a longitudinal axis of the at least one externally threaded portion.

8. An apparatus as recited in claim 2 wherein:

the at least one internally threaded portion includes a plurality of threads, the respective notches in each of the plurality of threads forming a line which is skewed from a longitudinal axis of the at least one externally threaded portion.

9. An apparatus as recited in claim 2 wherein:

the at least one internally threaded portion includes a plurality of threads, each notch in each of the plurality of threads increasing in size along a length of the at least one threadably engaged section.

10. An apparatus as recited in claim 1 wherein:

the at least one internally threaded portion includes at least one first thread, the at least one first region being a flat formed in the at least one first thread, each flat being cut to a depth which is less than a full depth of the at least one first thread.

11. An apparatus as recited in claim 10 wherein:

at least one externally threaded portion includes at least one second thread, the at least one second region being a notch formed in the at least one second thread, each notch being formed to a depth which is less than a full depth of the at least one second thread.

12. An apparatus as recited in claim 11 wherein:

the at least one externally threaded portion includes a plurality of threads, the respective notches in each of the plurality of threads forming a line which is parallel to a longitudinal axis of the at least one externally threaded portion.

13. An apparatus as recited in claim 11 wherein:

the at least one externally threaded portion includes a plurality of threads, the respective notches in each of the plurality of threads forming a line which is skewed from a longitudinal axis of the at least one externally threaded portion.

14. An apparatus as recited in claim 11 wherein:

the at least one externally threaded portion includes a plurality of threads, each notch in each of the plurality of threads increasing in size along a length of the at least one threadably engaged section.

15. An apparatus as recited in claim 10 wherein:

the at least one internally threaded portion includes a plurality of threads, the respective flats in each of the plurality of threads forming a line which is parallel to a longitudinal axis of the at least one externally threaded portion.

16. An apparatus as recited in claim 10 wherein:

the at least one externally threaded portion includes a plurality of threads, the respective flats in each of the plurality of threads forming a line which is skewed from a longitudinal axis of the at least one externally threaded portion.

17. An apparatus as recited in claim 10 wherein:

the at least one internally threaded portion includes a plurality of threads, each flat in each of the plurality of threads increasing in size along a length of the at least one threadably engaged section.

18. An apparatus as recited in claim 10 wherein:

the at least one internally threaded portion includes a plurality of threads, each flat in each of the plurality of threads varying in depth along a length thereof.

* * * * *

UNITED STATES PATENT AND TRADEMARK OFFICE

CERTIFICATE OF CORRECTION

PATENT NO. : 5,782,557
DATED : 21 July 1998
INVENTOR(S) : David J. Young

It is certified that error appears in the above-identified patent and that said Letters Patent is hereby corrected as shown below:

On the title page item --[22] PCT Filed: Oct. 25, 1994--

Signed and Sealed this

Tenth Day of November 1998

Bruce Lehman

*Attest:*

BRUCE LEHMAN

*Attesting Officer*

*Commissioner of Patents and Trademarks*